United States Patent [19]

Obland

[11] 4,442,636

[45] Apr. 17, 1984

[54] DUAL HEAD EDGE SHARPENING DEVICE FOR SKIS

[76] Inventor: Donald R. Obland, 6750 S. Clermont St., Littleton, Colo. 80122

[21] Appl. No.: 341,837

[22] Filed: Jan. 22, 1982

[51] Int. Cl.[3] ..... B24B 9/02

[52] U.S. Cl. ..... 51/205 WG; 51/354; 15/236 R; 30/172; 76/83; 76/88; 144/114 A; 144/115; 280/809

[58] Field of Search ..... 51/40, 59 R, 170 R, 51/204, 205, 205 WG, 241 S, 241 G, 241 R, 285, 326, 327, 330, 354; 15/236 R; 29/80; 30/172, 287; 76/83, 88; 144/114 A, 115; 280/809

[56] References Cited

U.S. PATENT DOCUMENTS

| | | | |
|---|---|---|---|
| 2,507,826 | 5/1950 | Spencer | 51/354 X |
| 3,146,564 | 9/1964 | Renfroe | 51/241 R |
| 3,643,328 | 2/1972 | Wainwright, Jr. | 30/172 |
| 3,766,649 | 10/1973 | Winbauer | 30/287 |
| 3,837,123 | 9/1974 | Bradbury | 51/208 |
| 3,875,825 | 4/1975 | Buttafuoco | 51/205 WG X |
| 3,899,942 | 8/1975 | Bradbury | 51/208 X |
| 3,990,147 | 11/1976 | Gill et al. | 30/172 |
| 4,060,013 | 11/1977 | Thompson | 76/83 |

*Primary Examiner*—Frederick R. Schmidt
*Assistant Examiner*—Robert P. Olszewski
*Attorney, Agent, or Firm*—Ancel W. Lewis, Jr.

[57] ABSTRACT

An edge sharpening device that simultaneously sharpens the edge faces on both sides of the skis has a handgrippable support (31) capable of changing in length that carries a pair of opposed edge sharpening heads (32, 33). The heads are movable to a spread position by the changing of the length of the support and a biasing band (61) urges the side sharpening faces (44, 45, 54, 55) of sharpening blocks against the side surfaces of the ski during a reciprocating movement of the device. The heads have bottom sharpening faces (48, 58) that are manually urged against the bottom surfaces of the ski during the reciprocating movement of the device. A flexible mounting provided by heads (68, 78) and sockets (64, 74) permits the heads to turn from side to side about a vertical axis to follow the taper of a ski of varying width during the sharpening operation.

15 Claims, 5 Drawing Figures

DUAL HEAD EDGE SHARPENING DEVICE FOR SKIS

Technical Field

This invention relates to a novel and improved device for sharpening the metal edges of snow skis and the like.

BACKGROUND ART

Snow skis presently in use have metal edges extending along the bottom at both sides. The side and bottom surfaces which define these metal edges become dull after extended use and sharpening and smoothing of these surfaces improves the performance of the ski. Some Attempts have been made to provide sharpeners for these metal edges. One common approach to this problem has been to provide an edge sharpener that sharpens and smoothes only one metal edge at a time, as is illustrated in U.S. Pat. Nos. 3,837,123 and 3,899,942. Some attempts have been made to provide a pair of oppositely disposed edge sharpeners on a common support to simultaneously sharpen both edges. Examples of the latter devices are shown in U.S. Pat. Nos. 3,643,328, 3,875,825, and 4,060,013.

DISCLOSURE OF INVENTION

An edge sharpening device for snow skis and the like is disclosed having a pair of opposed edge sharpening heads mounted on a common hand-gripped support that is adjustable in length to permit the heads first to be spread apart and then to be moved inwardly against the metal edge strips to accommodate different ski widths. The edge sharpening heads are resiliently urged together so that sharpening side faces of the heads simultaneously engage both metal side surfaces on the skis. Bottom sharpening faces of the heads are manually urged down against the metal bottom surfaces of a metal edge strip of an inverted ski. A flexible mounting for the edge sharpening heads on the outer end portions of the common support allows the sharpening side faces to follow angled side surfaces of the metal edge strip as the device is moved back and forth relative to the ski.

BRIEF DESCRIPTION OF DRAWINGS

The details of this invention will be described in connection with the accompanying drawings, in which.

DETAILED DESCRIPTION

Figure 1:
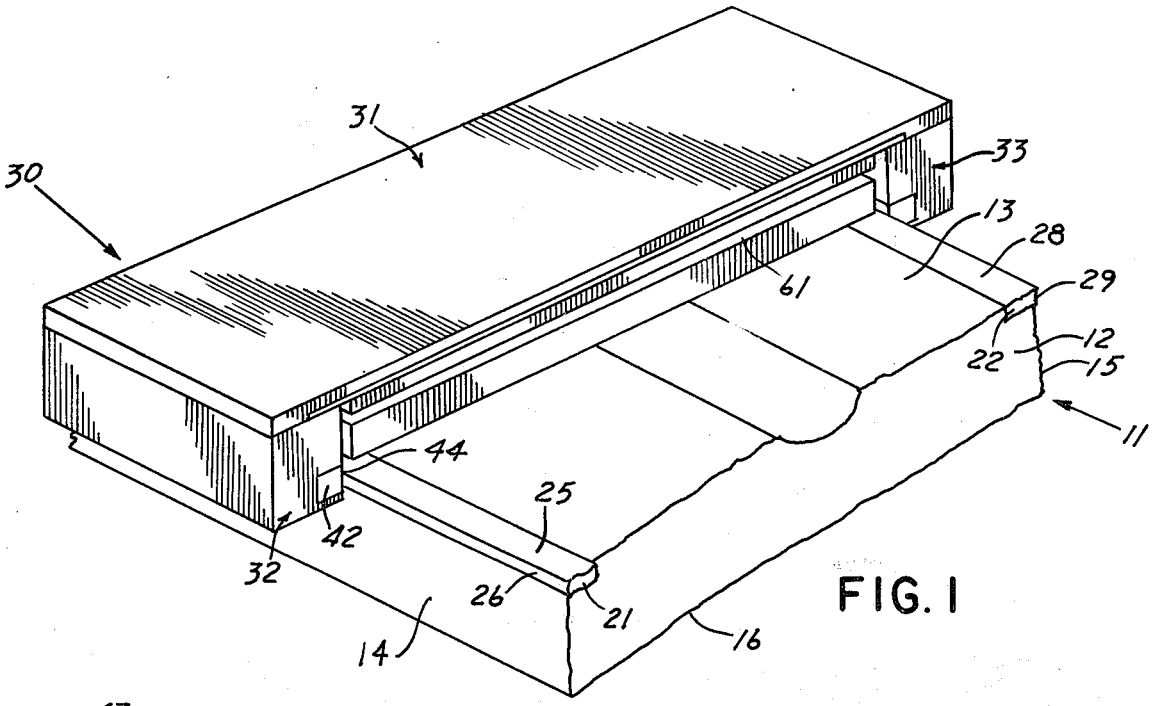
FIG. 1 is a perspective view of an edge sharpening device embodying features of the present invention, shown in an operative position on an inverted snow ski.
Figure 2:
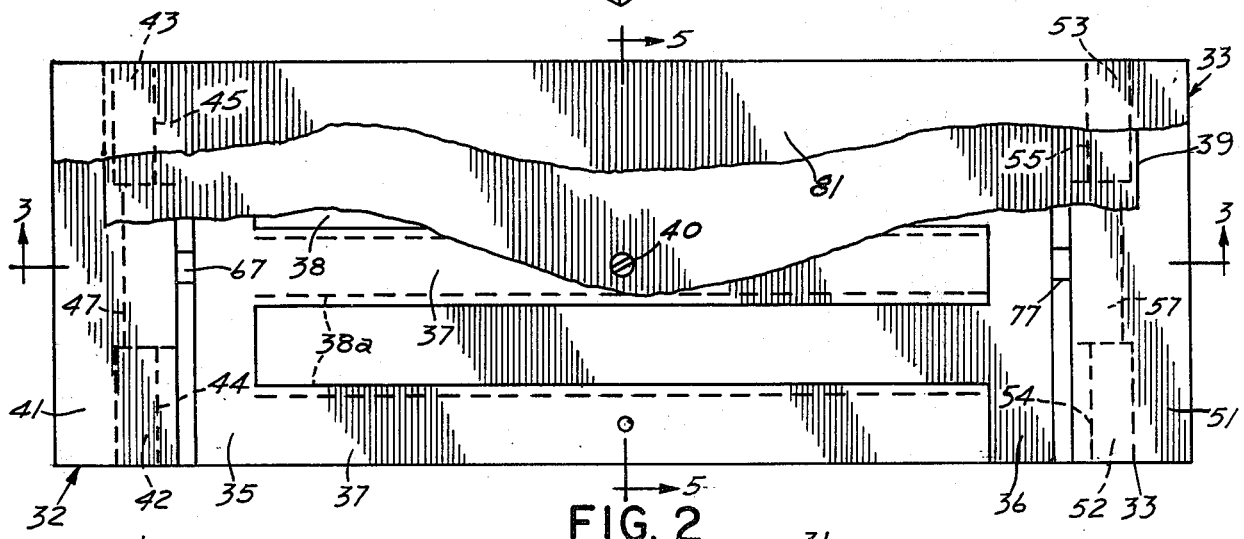
FIG. 2 is a top plan view of the device shown in FIG. 1 without the ski and with top portions broken away to show interior construction.
Figure 3:
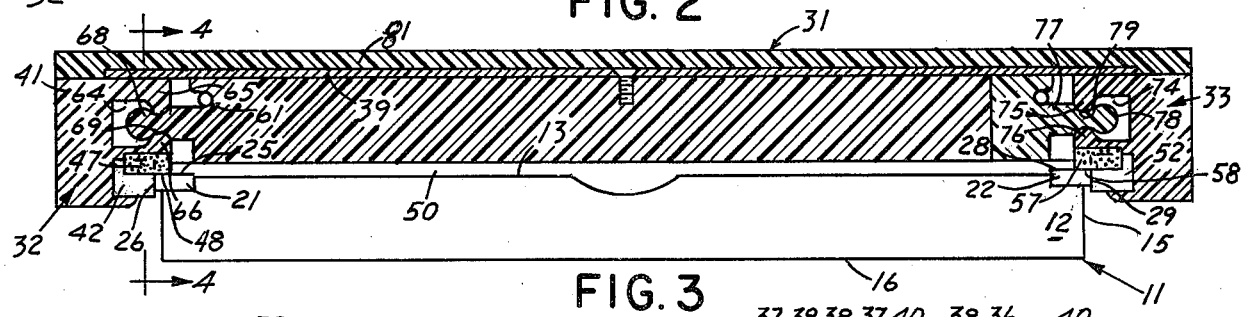
FIG. 3 is a sectional view taken along lines 3—3 of FIG. 2 showing the device mounted in an operative position on a ski.
Figure 4:
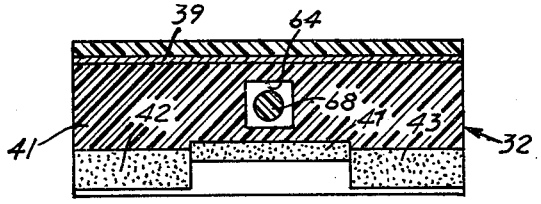
FIG. 4 is a sectional view taken along lines 4—4 of FIG. 3.
Figure 5:
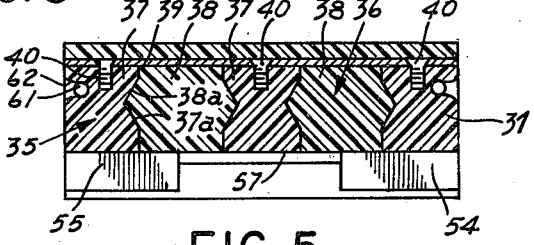
FIG. 5 is a sectional view taken along lines 5—5 of FIG. 2.

Referring now to the drawings, a conventional snow ski 11 is shown in an inverted position and has an elongated main body 12, usually constructed of a plastic material, with a bottom surface 13, oppositely disposed side surfaces 14 and 15, and a top surface 16. The ski has a pair of metal edge strips 21 and 22, each mounted in an associated recess formed in bottom portions at both sides of the ski. One metal edge strip 21 has an outer edge defined by a bottom surface 25 and a side surface 26. Similarly, the other metal edge strip 22 has an outer edge defined by a bottom surface 28 and a side surface 29. These metal edges provide a biting action in snow and ice during the use of the ski. Bottom surfaces 25 and 28 and side surfaces 26 and 29 are in a plane slightly beyond the respective bottom and side surfaces of the body of the ski.

A sharpening device 30 shown has a common support 31 that traverses or straddles a segment of the ski and carries a pair of edge sharpening heads 32 and 33 disposed at opposite ends thereof to simultaneously sharpen both the bottom and side surfaces of both metal strips as the sharpening device 30 is moved back and forth along the ski.

The common support 31 is adjustable in length and includes two interfitting slide plates 35 and 36 disposed end to end. Slide plate 35 has spaced, inwardly extending, finger-like extensions 37 and slide plate 36 has spaced, inwardly extending, finger-like extensions 38. Finger-like extensions 38 have laterally outwardly extending V-shaped projections **38*a* on opposite sides that are received in complementary V-shaped grooves 37*a* in extensions 37 to provide interfitting dovetail surfaces whereby one surface slides in the other in a guided movement to adjust the length of the support and thereby change the spacing between the sharpening heads 32 and 33**. The end portions of the plates opposite the finger-like extensions extend beyond the sides of the ski.

A flat rigid plate 39 is affixed to slide plate 37 as by metal screws 40. Plate 39 extends beyond the end portions of the plates and over the heads to hold them against upward movement relative to the top of the slide plates. A flexible cover 81, preferably of rubber or the like, which is able to stretch or expand and retract when extensions 38 are extended and retracted, the cover being soothing to a hand grip, fits over the entire rigid plate 39 and the outer end portion of the sharpening heads to complete the top structure of the device.

Each of the sharpening heads 32 and 33 is of an identical construction. Sharpening head 32 includes a support 41 on which there are mounted along the inner side two alined sharpening blocks 42 and 43 arranged end to end, each having a flat, vertical, side sharpening face 44 and 45, respectively, that bears against or engages the side surface 26 of the metal edge strip 21. A third sharpening block 47 between blocks 42 and 43 has a bottom sharpening face 48 that engages the bottom surface 25 of the adjacent metal edge strip 21 in response to a downwardly directed hand pressure. The sharpening faces are of a suitable material such as stone that is abrasive in character.

Similarly, head 33 includes a support body 51 on which there are mounted along an inner side edge two alined sharpening blocks 52 and 53 arranged end to end along a common axis, each having flat vertical side sharpening faces 54 and 55, respectively, that bear against or engage the side surface 29 of metal edge strip 22. A third sharpening block 57 has a bottom sharpening face 58 that engages the bottom surface of the adjacent metal edge strip 22 in response to hand pressure. The location of the third blocks 47 and 57 with respect to the end support portions provides a space or gap 50 between the bottom of the support 31 and the ski 11.

A flexible endless band 61 is mounted in a peripheral recess 62 extending along the outer sides and ends in the slide plates 35 and 36 which pull the plates together and thereby the oppositely disposed sharpening faces of the sharpening heads against the opposed side faces 26 and 29 of the metal strips. A downward force of the support by the user forces the bottom sharpening faces 48 and 58 against the bottom surfaces 25 and 28, respectively, of the metal strip.

The support body 41 of sharpening head 32 further has a socket 64 extending into an inner side with two opposed inwardly projecting lip portions 65 and 66 forming a restriction at the entrance of the socket 64. A generally pin-shaped male section 67 with a rounded head 68 at the outer end and a narrower neck 69 inwardly of the head is releasably held by lip portions 65 and 66. The male section is mounted on the outer end of the slide plate 35.

Similarly, a support body 51 of sharpening head 33 has a female socket 74 formed in the inner side thereof including two lip portions 75 and 76 forming a restriction at the entrance. A pin-shaped male section 77 having a rounded head 78 and a neck 79 inwardly of the head is releasably held by lip portions 75 and 66 in the outer end of the slide plate 36. This construction enables the heads to be snap-fit on the end portions of the slide plates and further allows the sharpening blocks and associated sharpening faces to flex and turn from side to side about a vertical axis to follow the angle of the side faces of the metal edge strips as the device is moved along the ski.

In applying the device to the ski the sharpening heads 32 and 33 are spread to a distance greater than the width of the ski against the forces of the flexible band 61 and, once in place, the band urges the sharpening side faces against the side surfaces of the metal edge strips. As the ski widens or narrows, the joint structure provided by heads 68 and 78 and sockets 64 and 74, respectively, flexes to allow the sharpening side faces to remain parallel to the edge surfaces of the ski.

For removal from the ski, the sharpening heads are spread apart to release the device from the ski.

Although the present invention has been described with a certain degree of particularity, it is understood that the present disclosure has been made by way of example and that changes in details of structure may be made without departing from the spirit thereof.

What is claimed is:

1. An edge sharpening device for snow skis and the like comprising:

a support that is adjustable in length having oppositely extending end support portions;

a pair of edge sharpening heads supported by said end support portions for reciprocal movement along opposite sides of a ski, each said head having a side sharpening face for engaging an adjacent side surface of a metal edge strip and a bottom sharpening face for engaging an adjacent bottom face of a metal edge strip, said heads being flexibly mounted on said end support portions to enable said side sharpening faces to turn from side to side to follow the taper of a metal edge strip of a ski of varying width; and biasing means associated with said support for enabling said edge sharpening heads to be spread apart and then be brought closer together to position said heads on the ski for edge sharpening and for simultaneously urging said heads toward one another and against adjacent side surfaces of the pair of metal edge strips on the ski.

2. An edge sharpening device as set forth in claim 1 wherein said support is adjustable in length and includes first and second slide plates disposed end to end, each with inwardly extending finger-like extensions having interfitting slide surfaces arranged for the guided movement of said end support portions toward and away from one another.

3. An edge sharpening device as set forth in claim 2 wherein said interfitting slide surfaces are generally dovetailed in configuration.

4. An edge sharpening device as set forth in claim 1 wherein said end support portions have a generally pin-shaped male section with a rounded head at the outer end and a narrower neck inwardly of the head and each sharpening head has a socket with opposed inwardly projecting lip portions whereby said male section is inserted into said socket and said lip portions extend into said neck to form a snap-fit pivotal mounting for each head on an associated end support portion.

5. An edge sharpening device as set forth in claim 1 wherein each of said heads has alined first and second sharpening blocks mounted on a common support body and a third sharpening block between said first and second blocks and disposed at a position higher than said first and second blocks.

6. An edge sharpening device as set forth in claim 1 wherein said biasing means is in the form of a resilient endless band that encompasses a pair of opposed slide plates forming a part of said support.

7. An edge sharpening device as set forth in claim 1 wherein each of said heads has a generally rectangularly shaped support body and said sharpening faces are provided by generally rectangularly shaped blocks recessed in said support body.

8. An edge sharpening device as set forth in claim 1 wherein said sharpening faces are of an abrasive character.

9. An edge sharpening device as set forth in claim 1 wherein the length and width of said support and heads is sized to be grasped by one hand for its movement along the ski.

10. An edge sharpening device as set forth in claim 1 wherein each end support portion is an integral part of one of a pair of opposed interfitting slide plates.

11. A dual head edge sharpening device for snow skis and the like comprising:

a hand-gripped support that is adjustable in length including opposed slide plates having interfitting dovetailed slide surfaces and oppositely extending end support portions, said slide plates having inwardly extending finger-like extensions;

a pair of edge sharpening heads supported by said end support portions for reciprocal movement along opposite sides of a ski traversed by said support, said support being spaced from the bottom surface of the ski, each of said heads having alined first and second sharpening blocks mounted on a common support body, each of said blocks having a side sharpening face for engaging an adjacent side surface of a metal edge strip carried by the ski, a third sharpening block on said support body between and disposed at a position higher than said first and second sharpening blocks, said third block having a bottom sharpening face for engaging an adjacent bottom face of the metal edge strip, said heads being pivotally mounted on said end support portions to enable said side sharpening faces to turn from side to side about a vertical axis to follow the taper of a metal edge strip of a ski of varying width, said pivotal mounting being provided by a male section at the end of said end support portion with a rounded head at the outer end and a narrower neck inwardly of the head, each sharpening head having a socket with opposed inwardly projecting lip portions whereby said male section is releasably inserted into said socket and said lip portions extend into said neck; and a resilient endless band encompassing said slide plates for enabling said edge sharpening heads to be spread apart by lengthening said support and then be moved laterally inwardly against adjacent side surfaces of said metal edge strips.

12. A dual head edge sharpening device as set forth in claim 11 including a rigid plate secured to one of said slide plates and extending beyond the ends of said slide plates to prevent said heads from pivoting in an upward direction relative to the top of said slide plates.

13. A dual head edge sharpening device as set forth in claim 12 including a flexible top cover of a hand-grippable configuration disposed over said rigid plate and an end portion of said heads.

14. A dual head ski edge sharpening device as set forth in claim 13 wherein said endless band fits in a recess extending into the side of said plates above said male sections.

15. A dual head ski edge sharpening device as set forth in claim 11 wherein said slide plates, cover, rigid plate, and first and second blocks are coextensive in lateral extent.

* * * * *